US011225357B2

(12) United States Patent
Gersovitz

(10) Patent No.: US 11,225,357 B2
(45) Date of Patent: Jan. 18, 2022

(54) MULTI-COMPARTMENT CONTAINER

(71) Applicant: Gerry Gersovitz, San Francisco, CA (US)

(72) Inventor: Gerry Gersovitz, San Francisco, CA (US)

( * ) Notice: Subject to any disclaimer, the term of this patent is extended or adjusted under 35 U.S.C. 154(b) by 207 days.

(21) Appl. No.: 16/457,434

(22) Filed: Jun. 28, 2019

(65) Prior Publication Data

US 2019/0322415 A1 Oct. 24, 2019

Related U.S. Application Data

(60) Continuation-in-part of application No. 15/434,988, filed on Feb. 16, 2017, now Pat. No. 10,442,569, which is a continuation of application No. 14/542,507, filed on Nov. 14, 2014, now Pat. No. 9,611,073, which is a division of application No. 12/622,853, filed on Nov. 20, 2009, now Pat. No.
(Continued)

(51) Int. Cl.

| | |
|---|---|
| ***B65B 69/00*** | (2006.01) |
| ***B65D 21/02*** | (2006.01) |
| ***B65D 51/20*** | (2006.01) |
| ***B65B 7/28*** | (2006.01) |
| ***B65B 5/04*** | (2006.01) |
| *B65D 25/04* | (2006.01) |

(52) U.S. Cl.

CPC ..... *B65D 21/0227* (2013.01); *B65B 5/04* (2013.01); *B65B 7/28* (2013.01); *B65B 69/00* (2013.01); *B65D 21/0224* (2013.01); *B65D 51/20* (2013.01); *B65D 25/04* (2013.01); *B65D 2251/0028* (2013.01); *B65D 2251/0093* (2013.01)

(58) Field of Classification Search

CPC ..... B65B 69/00; B65B 5/04; B65B 69/0008; B65B 7/28; B65D 31/12; B65D 25/04; B65D 51/20; B65D 21/0227

See application file for complete search history.

(56) References Cited

U.S. PATENT DOCUMENTS

| | | | |
|---|---|---|---|
| 771,372 | A | 10/1904 | Kruse |
| 861,815 | A | 7/1907 | Cullen |

(Continued)

FOREIGN PATENT DOCUMENTS

| | | |
|---|---|---|
| CA | 2737981 | 10/2014 |
| FR | 2701924 | 9/1994 |
| WO | 2018/006085 | 1/2018 |

OTHER PUBLICATIONS

Final Office Action for U.S. Appl. No. 10/948,837 dated Mar. 6, 2008, 8 pages.

(Continued)

*Primary Examiner* — Stephen J Castellano

(74) *Attorney, Agent, or Firm* — Kilpatrick Townsend & Stockton LLP

(57) ABSTRACT

Described herein are multi-unit storage devices where two separate compartments are joined in a manner such that accessing one of the compartments does not compromise product held in the other compartment. The separate compartments may be vacuum or otherwise sealed such that when the seal is broken, access to the products contained therein is provided. Each of the compartments may be independently sealed.

20 Claims, 14 Drawing Sheets

Related U.S. Application Data

8,915,395, which is a continuation-in-part of application No. 12/415,910, filed on Mar. 31, 2009, now abandoned, which is a division of application No. 10/948,837, filed on Sep. 22, 2004, now Pat. No. 7,571,829, application No. 16/457,434, which is a continuation-in-part of application No. 14/693,765, filed on Apr. 22, 2015, which is a division of application No. 13/093,468, filed on Apr. 25, 2011, now abandoned.

(60) Provisional application No. 60/505,410, filed on Sep. 23, 2003, provisional application No. 61/345,974, filed on May 18, 2010.

(56) References Cited

U.S. PATENT DOCUMENTS

| | | | | |
|---|---|---|---|---|
| 1,634,569 | A | 7/1927 | Bray | |
| 1,798,071 | A | 3/1931 | Deane | |
| 1,814,180 | A | 7/1931 | Nicholls | |
| 1,837,343 | A | 12/1931 | Starke et al. | |
| 1,889,882 | A | 12/1932 | Woods | |
| 1,984,570 | A | 12/1934 | Emmons | |
| 2,073,636 | A | 3/1937 | Holoubek | |
| 2,296,951 | A | 9/1942 | Rosen et al. | |
| 2,371,173 | A | 3/1945 | Hothersall | |
| 2,553,559 | A | 5/1951 | Eckman | |
| 2,605,013 | A | 7/1952 | Rubenstein | |
| 2,611,499 | A | 9/1952 | Mayer | |
| 2,679,281 | A | 5/1954 | Paulucci | |
| 2,833,436 | A | 5/1958 | Ruderian | |
| 2,963,194 | A | 12/1960 | Brennan et al. | |
| 3,106,313 | A | 10/1963 | Kurhan | |
| 3,113,668 | A | 12/1963 | Taylor | |
| 3,144,152 | A | 8/1964 | Kopp | |
| 3,199,756 | A | 8/1965 | Davy | |
| 3,272,671 | A | 9/1966 | Gaylord et al. | |
| 3,288,342 | A | 11/1966 | Tinker | |
| 3,317,087 | A | 5/1967 | Landis | |
| 3,465,905 | A | 9/1969 | Schottanes | |
| 3,485,416 | A | 12/1969 | Fohrman | |
| 3,580,481 | A | 5/1971 | Koboldt | |
| 4,044,941 | A | 8/1977 | Knudsen | |
| 4,078,686 | A | 3/1978 | Karesh | |
| D270,135 | S | 8/1983 | Gates | |
| 4,444,324 | A | 4/1984 | Grenell | |
| D280,599 | S | 9/1985 | Green | |
| 4,598,832 | A | 7/1986 | Alonso | |
| 4,664,274 | A | 5/1987 | Konrad | |
| 4,890,759 | A | 1/1990 | Scanga et al. | |
| 4,925,055 | A | 5/1990 | Robbins, III et al. | |
| 4,972,657 | A * | 11/1990 | McKee ..... | A61J 7/0076 206/534 |
| 4,981,214 | A | 1/1991 | Rojas | |
| 5,076,430 | A | 12/1991 | Philpot | |
| 5,258,191 | A | 11/1993 | Hayes | |
| 5,279,841 | A | 1/1994 | Yu | |
| 5,353,985 | A | 10/1994 | Nageli et al. | |
| 5,385,294 | A | 1/1995 | Andersson et al. | |
| 5,388,699 | A | 2/1995 | Ratajczak et al. | |
| 5,499,738 | A | 3/1996 | Burleigh | |
| 5,630,523 | A | 5/1997 | Wright | |
| 5,664,671 | A | 9/1997 | Nedblake, Jr. | |
| 5,669,523 | A | 9/1997 | Mueller et al. | |
| 5,692,626 | A | 12/1997 | Wehrle et al. | |
| 5,722,540 | A | 3/1998 | Laird et al. | |
| 5,731,020 | A | 3/1998 | Russo | |
| 5,803,294 | A | 9/1998 | Bello et al. | |
| 5,954,213 | A | 9/1999 | Gerhart et al. | |
| 6,105,812 | A | 8/2000 | Riordan | |
| 6,138,899 | A | 10/2000 | Grabher | |
| D434,312 | S | 11/2000 | Pegler et al. | |
| 6,145,685 | A | 11/2000 | Dick | |
| 6,179,146 | B1 | 1/2001 | Betras | |
| 6,196,412 | B1 | 3/2001 | Cattell | |
| 6,415,940 | B1 | 7/2002 | Brabson, II | |
| 6,450,351 | B1 | 9/2002 | Thompson | |
| 6,499,614 | B1 | 12/2002 | Thompson | |
| 6,708,735 | B1 | 3/2004 | Kenihan | |
| 6,723,360 | B1 | 4/2004 | Dunaway | |
| 6,955,028 | B1 | 10/2005 | Dunaway | |
| 6,971,521 | B2 | 12/2005 | Pinyot | |
| 7,516,596 | B2 | 4/2009 | Henderson et al. | |
| 7,571,829 | B2 | 8/2009 | Gersovitz | |
| 8,449,186 | B2 | 5/2013 | Bray | |
| 8,915,395 | B2 | 12/2014 | Gersovitz | |
| 9,611,073 | B2 | 4/2017 | Gersovitz | |
| 10,407,214 | B2 | 9/2019 | Gersovitz | |
| 10,442,569 | B2 | 10/2019 | Gersovitz | |
| 2001/0030134 | A1 | 10/2001 | Goglio et al. | |
| 2001/0040164 | A1 | 11/2001 | Cleator | |
| 2002/0088730 | A1 | 7/2002 | Galomb | |
| 2002/0130126 | A1 | 9/2002 | Rosenberg | |
| 2004/0121047 | A1 | 6/2004 | Cohen | |
| 2004/0159625 | A1 | 8/2004 | Kwon | |
| 2004/0231111 | A1 | 11/2004 | Martinez et al. | |
| 2005/0173501 | A1 | 8/2005 | Jones | |
| 2006/0219719 | A1 | 10/2006 | Dixon | |
| 2006/0257534 | A1 | 11/2006 | Maddock | |
| 2007/0012710 | A1 | 1/2007 | Vovan | |
| 2007/0267416 | A1 | 11/2007 | Eichenbaum | |
| 2008/0072481 | A1 | 3/2008 | Conrad et al. | |
| 2009/0236346 | A1 | 9/2009 | Hofeldt et al. | |
| 2009/0241477 | A1 | 10/2009 | Gersovitz et al. | |
| 2010/0065557 | A1 | 3/2010 | Gersovitz | |
| 2010/0142861 | A1 | 6/2010 | Sam | |
| 2010/0142862 | A1 | 6/2010 | Sam | |
| 2010/0159096 | A1 | 6/2010 | Sam | |
| 2011/0253725 | A1 | 10/2011 | Killian | |
| 2011/0284550 | A1 | 11/2011 | Gersovitz | |
| 2015/0175303 | A1 | 6/2015 | Gersovitz | |
| 2017/0297769 | A1 | 10/2017 | Gersovitz | |

OTHER PUBLICATIONS

Non-Final Office Action for U.S. Appl. No. 10/948,837 dated Jul. 27, 2007, 6 pages.

Non-Final Office Action for U.S. Appl. No. 10/948,837 dated Sep. 8, 2008, 9 pages.

Notice of Allowance for U.S. Appl. No. 10/948,837 dated Feb. 10, 2009, 8 pages.

Non-Final Office Action for U.S. Appl. No. 12/415,910 dated Sep. 23, 2010, 9 pages.

Final Office Action for U.S. Appl. No. 12/622,853 dated Feb. 12, 2013, 8 pages.

Non-Final Office Action for U.S. Appl. No. 12/622,853 dated Sep. 11, 2012, 6 pages.

Non-Final Office Action for U.S. Appl. No. 12/622,853 dated Jul. 15, 2014, 9 pages.

Notice of Allowance for U.S. Appl. No. 12/622,853 dated Nov. 3, 2014, 7 Pages.

Final Office Action for U.S. Appl. No. 13/093,468 dated Sep. 23, 2014, 10 pages.

Final Office Action for U.S. Appl. No. 13/093,468 dated Feb. 12, 2013, 14 pages.

Non-Final Office Action for U.S. Appl. No. 13/093,468 dated May 8, 2014, 11 pages.

Non-Final Office Action for U.S. Appl. No. 13/093,468 dated Jul. 23, 2012, 9 pages.

Non-Final Office Action for U.S. Appl. No. 13/093,468 dated May 1, 2015, 9 pages.

Advisory Action for U.S. Appl. No. 14/542,507 dated Feb. 5, 2016, 3 pages.

Final Office Action for U.S. Appl. No. 14/542,507 dated Oct. 28, 2015, 10 pages.

Non-Final Office Action for U.S. Appl. No. 14/542,507 dated Apr. 21, 2016, 8 pages.

Non-Final Office Action for U.S. Appl. No. 14/542,507 dated Jul. 17, 2015, 8 pages.

(56) References Cited

OTHER PUBLICATIONS

Notice of Allowance for U.S. Appl. No. 14/542,507 dated Nov. 21, 2016, 7 pages.
Advisory Action for U.S. Appl. No. 14/693,765 dated Jul. 31, 2017, 3 pages.
Final office Action for U.S. Appl. No. 14/693,765 dated Apr. 24, 2017, 11 pages.
Final Office Action for U.S. Appl. No. 14/693,765 dated May 14, 2018, 17 pages.
Non-Final Office Action for U.S. Appl. No. 14/693,765 dated Oct. 31, 2017, 12 pages.
Non-Final Office Action for U.S. Appl. No. 14/693,765 dated Aug. 28, 2019, 9 pages.
Non-Final Office Action for U.S. Appl. No. 14/693,765 dated Nov. 22, 2016, 9 pages.
Restriction Requirement for U.S. Appl. No. 14/693,765 dated Aug. 3, 2016, 6 pages.
Final Office Action for U.S. Appl. No. 15/434,988 dated Nov. 9, 2018, 10 pages.
Non-Final Office Action for U.S. Appl. No. 15/434,988 dated Jun. 29, 2018, 11 pages.
Notice of Allowance for U.S. Appl. No. 15/434,988 dated Jun. 5, 2019, 7 pages.
Restriction Requirement for U.S. Appl. No. 15/434,988 dated Mar. 15, 2018, 7 pages.
Non-Final Office Action for U.S. Appl. No. 15/640,793 dated Nov. 14, 2018, 9 pages.
Notice of Allowance for U.S. Appl. No. 15/640,793 dated Apr. 25, 2019, 5 pages.
Notice of Allowance for CA Application No. 2,737,981 dated Jul. 2, 2014, 1 page.
Office Action for CA Application No. 2,737,981 dated Feb. 3, 2014, 2 pages.
Office Action for CA Application No. 2,737,981 dated Sep. 6, 2012, 2 pages.
Office Action for CA Application No. 2,737,981 dated May 31, 2013, 4 pages.
International Preliminary Report on Patentability for International Application No. PCT/US2017/040583 dated Jan. 10, 2019, 6 pages.
International Search Report and Written Opinion International Application No. PCT/US2017/040583 dated Nov. 30, 2017, 6 pages.
Non-Final Office Action for U.S. Appl. No. 14/693,765, dated Apr. 30, 2020, 15 pages.

* cited by examiner

MULTI-COMPARTMENT CONTAINER

CROSS-REFERENCES TO RELATED APPLICATIONS

This application is a continuation-in-part of U.S. patent application Ser. No. 15/434,988, filed on Feb. 16, 2017, now U.S. Pat. No. 10,442,569, which is a continuation of U.S. patent application Ser. No. 14/542,507, filed on Nov. 14, 2014 (now issued as U.S. Pat. No. 9,611,073), which is divisional of U.S. patent application Ser. No. 12/622,853, filed on Nov. 20, 2009 (now issued as U.S. Pat. No. 8,915,395), which is a continuation-in-part of U.S. patent application Ser. No. 12/415,910, filed on Mar. 31, 2009 (now abandoned), which is a divisional of U.S. patent application Ser. No. 10/948,837, filed on Sep. 22, 2004 (now issued as U.S. Pat. No. 7,571,829), which claims priority to Provisional Application No. 60/505,410, filed on Sep. 23, 2003. This Application is also a continuation-in-part of U.S. patent application Ser. No. 14/693,765, filed on Apr. 22, 2015, which is a divisional of U.S. application Ser. No. 13/093,468, filed Apr. 25, 2011 (now abandoned), which claims priority and benefit from U.S. Provisional Application No. 61/345,974, filed May 18, 2010. The disclosures of each of the applications above are incorporated herein by reference in their entirety for all purposes.

BACKGROUND OF THE INVENTION

Embodiments of the present invention relate to packaging for consumer and commercial products that can lose potency or freshness when the package is opened and the contents are exposed to atmospheric conditions, such as oxygen and moisture in air. While such problems are present in traditional sizes and portions, they are a particularly pronounced in products that are typically purchased in "bulk" or "economy" sizes or take some amount of time to use or consume once the package has been opened. The amount of product or size of the portion that is considered "bulk" or "economy" sizes can depend on the nature of the product. For example, ground coffee can quickly lose its aromatic oils when exposed to air, while other dry goods, such as dry rice and dried beans, are much more stable when exposed to air. Other products, such as baking powder, can begin losing potency immediately upon exposure to air. Accordingly, the amount of the product that might be considered "bulk" or "economy" size can vary with the type of the product and its ability to maintain freshness upon exposure to air.

One particular problem with "bulk" or "economy" size single compartment packaging is that the entirety of the contents is exposed to the air once the package is opened for the first time and each time the package is accessed to remove more product. As such, the possible savings realized on a per serving or per use basis can be and are often lost due to spoilage or staleness of at least some of the product if not used in a timely manner. This problem is only exacerbated by the mandatory or voluntary removal of preservatives from many products and food stuffs.

Examples of conventional packages or containers that are used for consumer and commercial products may include a number of different types. Typical cans or canisters, are available in various sizes and proportions and made of various materials, such as metal, plastic, cardboard, paperboard, foil, Mylar™, or a composite of any of the foregoing. Conventional boxes or cartons, similarly, are available in various sizes and proportions and made of various materials, such as metal, plastic, cardboard, paperboard or a composite or combination of any of the foregoing. Conventional bags, also are available in various sizes and proportions and made of various materials, such as paper, plastic, Mylar™, foil or a combination of any of the foregoing. Plastics can include traditional variations of polyethylene. Each individual can, box, and bag are single compartment containers. As such, each exhibit a similar problem with single compartment containers in that once they are opened, the entire contents of the container are exposed to air and moisture.

As known, exposure to air and moisture can cause many products, such as food stuffs, to lose freshness or go stale. To avoid continued exposure to air and moisture, some configurations of the container may include re-sealable or reusable lids and closures. For example, a can might include a reusable plastic lid, a box might include a re-sealable top having some type of reusable adhesive, while a bag might be equipped with a re-sealable or reusable closure like a zipper or a clip. However, such re-sealable or reusable closures still allow the entirety of the remaining contents to be exposed to new air and moisture each time the package is opened to access the product.

One particular problem with "bulk" or "economy" size single compartment packaging is that the entirety of the contents is exposed to the air once the package is opened for the first time and each time the package is accessed to remove more product. As such, the possible savings realized on a per serving or per use basis can be and are often lost due to spoilage or staleness of at least some of the product if not used in a timely manner. This problem is only exacerbated by the mandatory or voluntary removal of preservatives from many products and food stuffs.

Additionally, In the packaging of certain products where freshness is a concern, it is desirable to have the products packaged under vacuum or seal to avoid exposure to the damaging effects of the atmosphere. By way of example, one such product is coffee. Typically, coffee is packaged in a single compartment can under vacuum. When the coffee can is opened and exposed to atmospheric conditions, all of the coffee in that coffee can may lose its aroma and flavor due to the effects of oxygen and moisture in the atmosphere. Consequently, there is a need for a container that gives consumers access to an amount of sealed products without compromising the freshness of all of the contents in the container.

BRIEF SUMMARY OF THE INVENTION

Broadly, the present invention provides a multi-unit storage device where two separate compartments are joined in a manner such that accessing one of the compartments does not compromise product held in the other compartment. The separate compartments may be vacuum or otherwise sealed such that when the seal is broken, access to the products contained therein is provided. Each of the compartments may be independently sealed.

In accordance with one aspect of the present invention, a multi-unit storage device includes a container comprising: a first end, a second end, at least one surface extending from the first end to the second end, a divider wall defining a first compartment extending from the divider wall to the first end and a second compartment extending from the divider wall to the second end, perforations in the at least one surface that can be used to detach the first compartment from the second compartment once the contents of the first compartment are depleted, a first seal coupled to the first compartment, and a second seal coupled to the second compartment, wherein at least one of the first seal or the second seal is a reusable closure element.

In accordance with one aspect of the present invention, a method of using a multi-compartment storage device includes obtaining the multi-compartment storage device, wherein the multi-compartment storage device comprises: a container having a first end, a second end, and at least one surface extending from the first end to the second end, a divider wall defining a first compartment extending from the divider wall to the first end and a second compartment extending from the divider wall to the second end, perforations in the at least one surface that can be used to detach the first compartment from the second compartment once the contents of the first compartment are depleted, a first seal coupled to the first compartment; and a second seal coupled to the second compartment, wherein at least one of the first seal or the second seal is a reusable closure element; opening the first seal; accessing and using product stored in the first compartment until depleted; opening the second seal after the product stored in the first compartment is depleted; and accessing and using product stored in the second compartment.

Other features and advantages of the present invention will be apparent upon review of the following detailed description of exemplary embodiments.

DETAILED DESCRIPTION OF THE INVENTION

Figure 1:
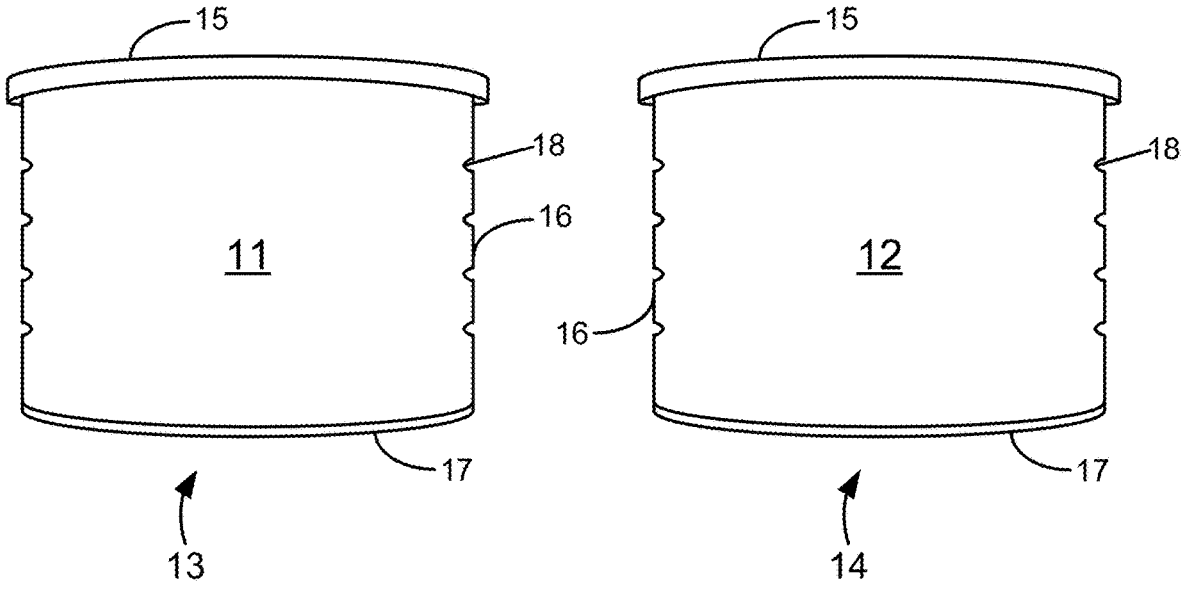
FIG. 1 is an elevation view of two containers for a multi-unit storage device in accordance with an embodiment of the present invention.
Figure 2:
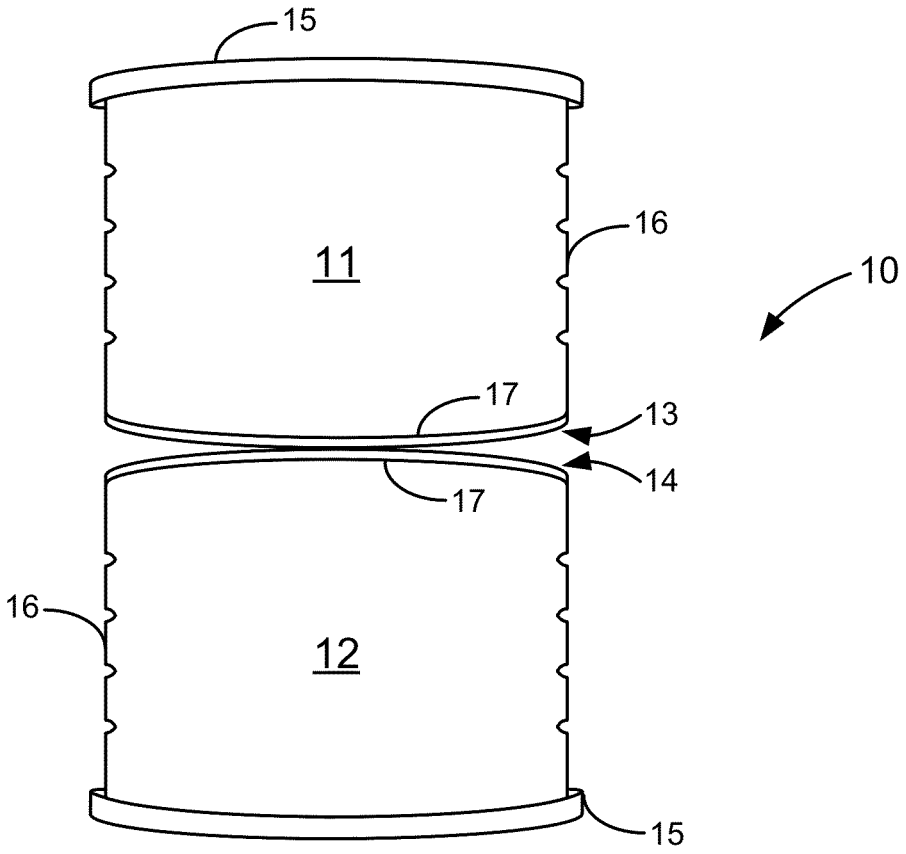
FIG. 2 is an elevation view of the two containers forming a multi-unit storage device in accordance with an embodiment of the present invention.

With reference to FIGS. 1 and 2, a multi-unit storage device 10 in accordance with an embodiment of the present invention is illustrated. The multi-unit storage device consists of two containers or cans 11, 12. The containers may be made of metal, in which case they are welded together at their bottom portions 13, 14. Glue or some other type of adhesive may also be used.

The top portions can be sealed with either metal, foil, plastic or any other suitable material. Examples for the two separate containers include coffee cans, nut cans, potato chip cans and other types of snacks. Lids 15 can be provided for closing or resealing the cans 11, 12.

The separate cans may be made using many manufacturing techniques. Early methods of making such cans included rolling a metallic body or sidewall 16 and coupling a metallic bottom 17 to the body portion with a folded or sealed flange. Additionally, the bottom may be coupled to the rolled body with a welding-type process. Modern methods include stamping or forming the bottom and body as a unitary body. In some embodiments, ribs or troughs 18 may be defined circumferentially in the body or sidewall to provide extra strength and stability.

Another example of a type of container that may be used as the containers to form the multi-unit storage device in accordance with the present invention includes a cardboard or plastic body 16 with a metal, or plastic bottom 17. The containers may also be made as a unitary body of plastic or other suitable material. Examples of such a container include orange juice cans, nut cans, coffee, some potato snack cans and other snack cans.

In use, two containers 11, 12 as described above are provided and are coupled together at their bottom portions 13, 14. Each can, container or compartment is filled with a product and then individually vacuum, nitrogen flush or otherwise sealed. This may be done before or after the two containers are coupled to one another. Each compartment may be filled with the same product or different products. Examples of products include, but are not limited to, coffee, nuts, potato chips, candy, tea, dried fruit, etc.

When one desires access to a product, one simply opens one compartment of the container. Thus, the second compartment remains unopened, thereby protecting the product therein from the elements and helping maintain freshness. When access to the second compartment is desired, the multi-unit storage device is "flipped" and the second compartment is opened. Each compartment may be closed with lids 15 if provided. One lid may be provided and used for both containers if desired.

Additionally, each compartment may be filled with a different product if it is so desired. For example, one compartment may include potato chips while the second container may include corn chips.

Figure 3:
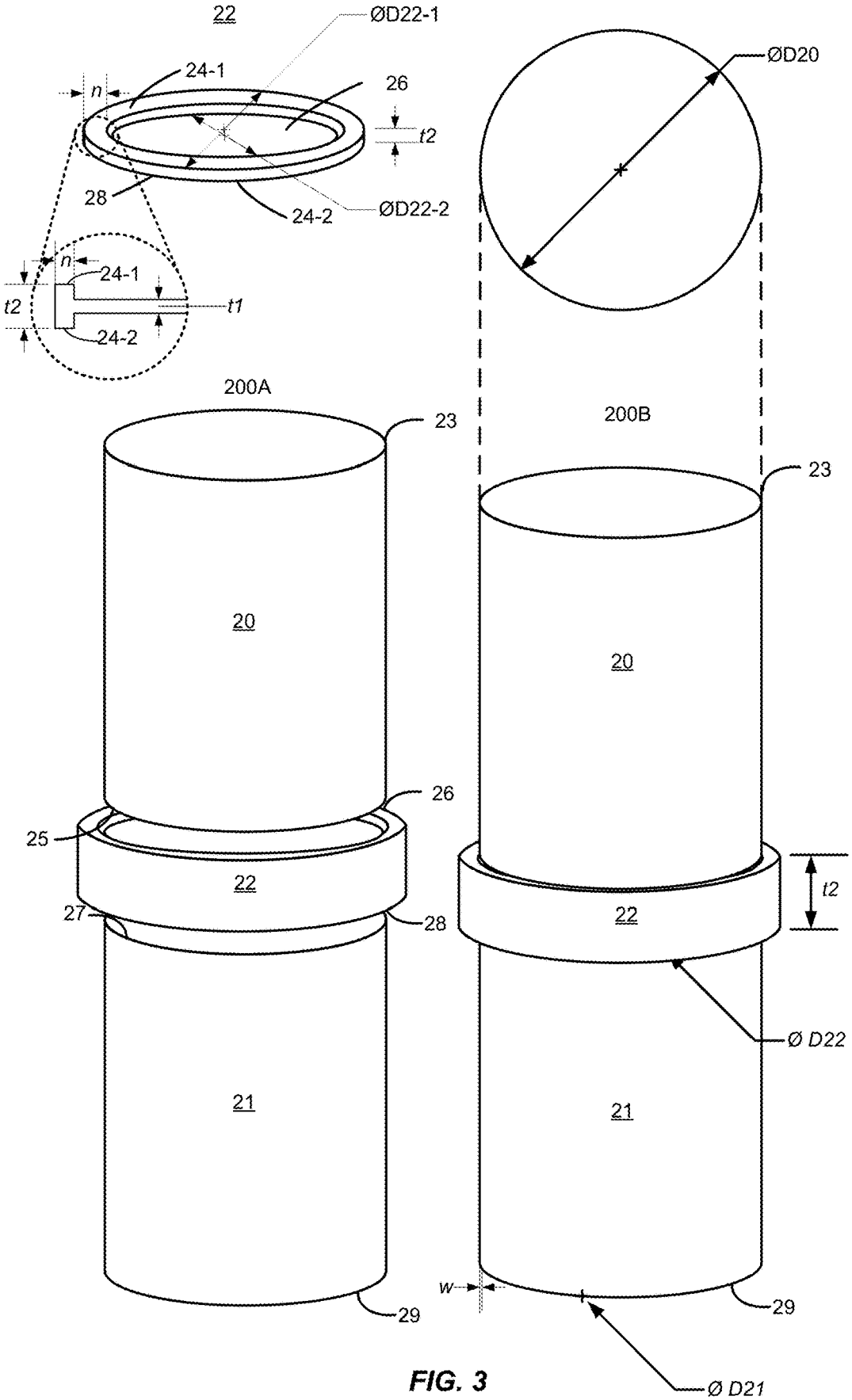
FIG. 3 is an elevation view of two cylinders and connecting-divider for a multi-unit storage device in accordance with an embodiment of the present invention.

FIG. 3 shows another embodiment according to the present invention. Elevation view 200A is the unassembled view of the multi-compartment container in elevation view 200B. As shown in FIG. 3, multi-compartment container in elevation view 200A can include a first cylinder 20, a connecting-divider 22 and a second cylinder 21. First cylinder 20 and second cylinder 21 can be made of any number of materials including, but not limited to, metal, plastic, cardboard, paper board, Mylar® and foil. In some embodiments, first cylinder 20 and second cylinder 21 can be made of a composite material that incorporates two or more of the aforementioned materials. For example, the substrate of first cylinder 20 and second cylinder 21 can include a cardboard substrate having a foil lining on the interior surface of the cylinder and a Mylar® or plastic coating on the exterior surface of the cylinder. Using or reducing the amount of metal in a container can drastically reduce the cost of producing and shipping the containers. Not only are the actual non-metal component materials less expensive, but there are many inexpensive techniques and machines that may be used for producing containers, cans, cylinders and dividers from non-metal materials.

In various embodiments, the first end 23 of the first cylinder 20 can have a top opening portion adapted to be sealed and capable of receiving a reusable lid to close the opening. Similarly, the second end 29 of the second cylinder 21 can also have a top opening portion adapted to be sealed and capable of receiving a reusable lid to close the opening. The reusable lid can be similar to the reusable lid 15 shown in FIGS. 1 and 2. The multi-compartment container or storage device pictured in FIG. 3 can be used, filled and accessed in manners similar to those described above.

In various embodiments, the first cylinder 20 and second cylinder 21 are hollow cylinders with a wall thickness, w, dimensioned to produce the structural rigidity suitable for containing and protecting products packaged therein, maintaining optional vacuum or pressure or stacking of multiple containers during shipping and display. The first cylinder can include an interior surface and an exterior surface with similar or dissimilar materials. For example, the exterior surface can be coated in a plastic film while the interior surface can be coated with a metal foil. The wall thickness, w, can depend on multiple factors, such as the intended use of the multi-compartment container, the material of the cylinders and the intended packaging method. For example, the wall thickness, w, for a cardboard cylinder can be thicker than that of a metal cylinder, especially if the resulting multi-compartment container is intended to be vacuum, pressure or nitrogen flushed sealed. Nitrogen flush sealing replaces the air inside the container to remove oxygen and moisture to help better preserve the freshness of the packaged products.

First cylinder 20 can have a first end 23 and a second end 25 and second cylinder 21 can have a first end 27 and a second end 29. Connecting-divider 22 can have a first side 26 and a second side 28 and have a unitary body construction. Multi-compartment container 200B can be assembled by attaching or coupling the second end 25 of first cylinder 20 with the first side 26 of connecting-divider 22 and attaching or coupling the first end 27 of cylinder 21 to the second side 28 of connecting-divider 22. The means of attaching or coupling the ends of the two cylinders 20 and 21 to the connecting-divider 22 can include, but are not limited to, adhesive, welding and crimping or any combination thereof In some embodiments, connecting-divider 22 can have lip section 24-1 on first side 26 and lip section 24-2 on second side 28. The width, n, of lip sections 24-1 and 24-2 can be defined by the difference between the diameter D22-2 of the solid inner portion of connecting-divider 22 and the outer diameter D 22-1 of connecting-divider 22. In some embodiments, diameter D22-2 can be dimensioned to slip or snug fit around the outside of diameter D20 of the first cylinder 20 and the second cylinder 21. In such embodiments, the first cylinder 20 and the second cylinder 21 can be inserted into the region defined by the lip sections 24-1 and 24-2, respectively. The lip sections 24-1 and 24-2 can be dimensioned so that the interior surface of lip sections 24-1 and 24-2 extend around the outer surfaces of first cylinder 20 and second cylinder 21, respectively. In some embodiments, adhesive can be applied to the inner surface of the lip sections or the outer surface of the cylinders ends to provide more surface area of adhesion. In other embodiments, the lip sections can be crimped or otherwise deformed so as to grab or engage the outer surfaces of the cylinders. In other embodiments, adhesive and crimping can be used to ensure a strong and airtight seal between the cylinders 20, 21 and connecting-divider 22.

The height of the lip sections can be dimensioned so as to provide additional surface area on which to apply adhesive between the connecting-divider 22 and the cylinders 20 and 21 to further strengthen the connection between the components. The height of the lip section can be defined as the difference between the thickness t1 of the solid inner portion of connecting-divider 22 and thickness t2. In some embodiments, the inner solid section of connecting-divider 22 is symmetrically arranged between lip section 24-1 and lip section 24-2. In other embodiments, the inner solid section of connecting-divider 22 can be arranged asymmetrically between the two lip sections. In some embodiments, the lip sections 24-1 and 24-2 can dimensioned with different diameters D22-2 so as to accommodate two cylinders with different dimensions such as wall thickness and diameter. For example, first cylinder 20 can have a diameter D20 and wall thickness w while second cylinder 21 can have a diameter different from diameter D20 and a wall thickness different from w.

When fully assembled, multi-compartment container 200B can have one compartment, or container, with walls of uniform diameter defined by the inner surface of cylinder 20 and a bottom defined by the first side 26 of the solid inner portion of connecting-divider 22 and another compartment, or container, with walls defined by the inner surface of cylinder 21 and the bottom defined by the second side 28 of the solid inner portion of connecting-divider 22. In some embodiments, connecting-divider 22 has no lip sections and second end 25 of the first cylinder 20 and the first end 27 of the second cylinder 21, each having some wall thickness w, are coupled to the surfaces of opposite sides of the connecting-divider 22.

In other embodiments, in which the walls are plastic or other material, the cylinders can have non-uniform diameter from one end to the other or other arbitrary shape as determined by the aesthetics or design of the packaging. For example, the plastic walls can have depressions or impressions that make it easier to hold or handle the multi-compartment container. Similarly, the compartments can any shape required by the product or the needs of the aesthetic design with two or more separately sealable/openable compartments, i.e. the shape of a cartoon character or trademark character.

Figure 4:
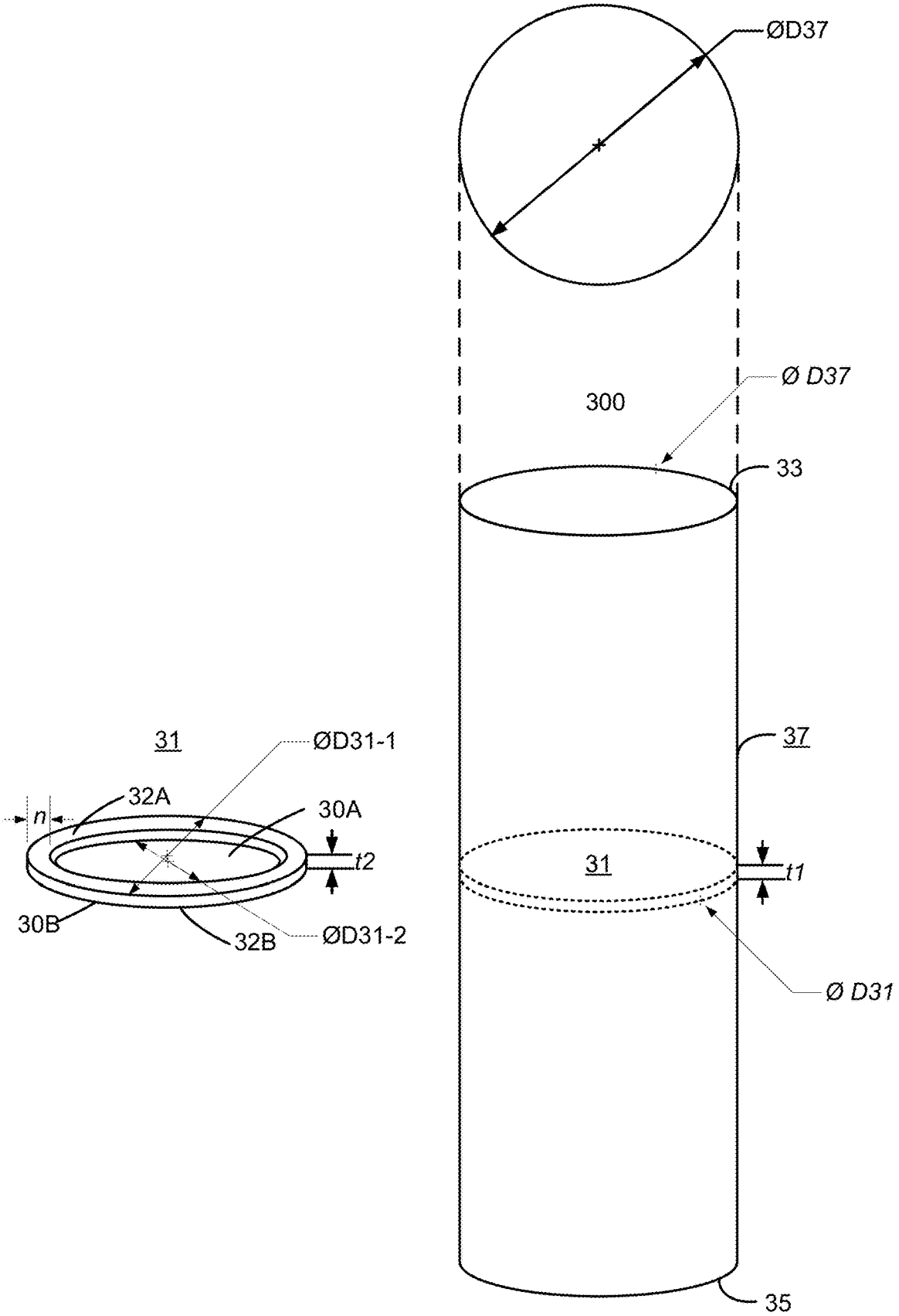
FIG. 4 is an elevation view of one cylinders and connecting-divider for a multi-unit storage device in accordance with an embodiment of the present invention.

FIG. 4 is an elevation view of yet another embodiment of the present invention. Multi-compartment container 300 can include a cylinder 37 having a first end 33 and a second end 35. A multi-compartment container 300 can also include a dividing wall 31. Cylinder 37 can have a diameter D37 dimensioned so that dividing wall 31, having a diameter D31, can slip or snugly fit within the inner diameter of cylinder 37. Dividing wall 31 can be coupled to the inner surface of cylinder 37 by any suitable means including, but not limited to, adhesive, welding, tacks and retaining rings or cylinders.

Dividing wall 31 can be made of any suitable material including, but not limited to, metal, plastic, cardboard, paper board, Mylar, foil or any combination or composite thereof. As shown in FIG. 4, dividing wall 31 can be a simple disk of some thickness t1 and diameter D31. Alternatively, dividing wall 31 can have structural or reinforcement lip sections 32A and 32B similar to that of the connecting-divider shown in FIG. 3. To conserve material and/or increase the structural integrity of the dividing wall 31, the dividing wall 31 can have a solid inner section between the first side 30A and second side 30B having a thickness t1 smaller than the thickness t2 between a surface of lip section 32A and a surface of lip section 32B. The dimension n of the dividing wall 31 can be defined as the difference between diameters D31-1 and D31-2. The dimension n can vary according to the requirements of a multi-compartment container and the materials used to construct dividing wall 31.

In some embodiments, the cylinder 37 and the dividing wall 31 can be molded as a unitary body. For example, the cylinder 37 and dividing wall can be injection molded out of plastic or other moldable as a unitary body. In such embodiments, the walls of the containers can be made of the same material.

Figure 5:
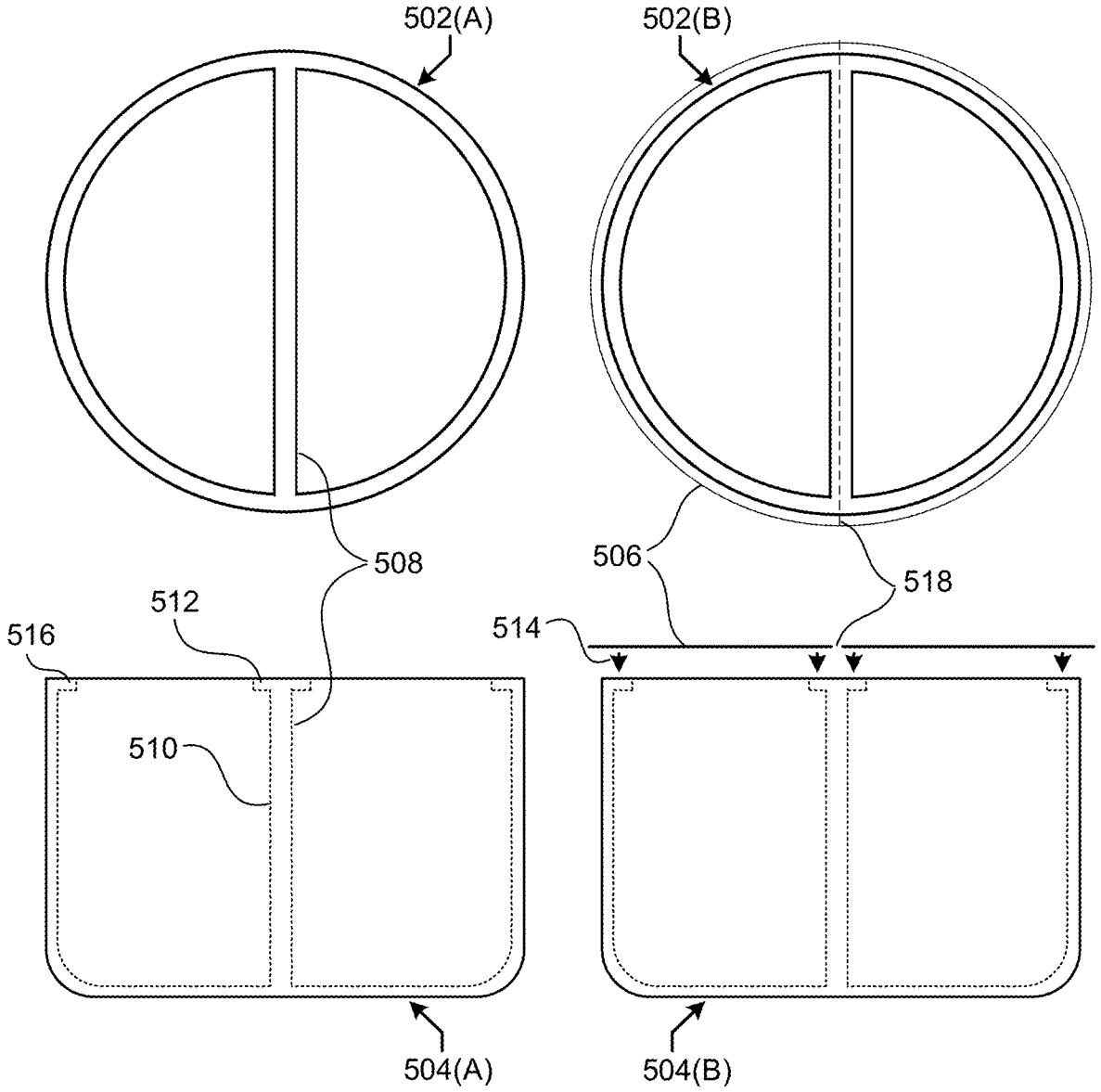
FIG. 5 is view of a multi-compartment container in which multiple compartments are divided via a divider wall in accordance with at least some embodiments.

FIG. 5 is view of a multi-compartment container in which multiple compartments are divided via a divider wall in accordance with at least some embodiments. In some embodiments, each of the multiple compartments may be independently sealed so that accessing one of the compartments does not compromise the contents of the other compartment. FIG. 5 depicts top-down views 502 (A and B) of the multi-compartment container, as well as side views 504 (A and B) of the multi-compartment container. In FIG. 5, views 502(A) and 504(A) depict the multi-compartment container without seal 506 whereas views 502(B) and 504 (B) depict the multi-compartment container with seal 506. In some embodiments, the outer walls of the multi-compartment container may be parallel. For example, the multi-compartment container may be cylindrical. In some embodiments, the outer walls of the multi-compartment container may be slanted. For example, the multi-compartment container may be conical.

As depicted in FIG. 5, multiple compartments may be formed in the multi-compartment container via the inclusion of a divider wall 508. The divider wall 508 may be a vertical divider. As depicted, divider wall 508 may be in contact with the outer wall, bottom, and top of the multi-compartment container. In some embodiments, the divider wall 508 may include an inner portion 510 and a reinforcement lip 512, where the reinforcement lip 512 is thicker than the inner portion 510 and runs along an outer edge of the divider wall 508.

In some embodiments, the multi-compartment container may be configured such that each compartment may be independently sealed. In some embodiments, a seal 506 may be adhered to the outer walls and divider wall 508 of the multi-compartment container via contact points represented as arrows 514. In some embodiments, the out wall may include a lip 516 which provides surface area for a contact point 514 at which the seal 506 may be adhered to the outer wall. Likewise, the reinforcement lip 512 may provide surface area for a contact point 514 at which the seal 506 may be adhered to the divider wall 508.

Seal 506 may be made of any suitable flexible material capable of preventing the passage of air or liquid into a compartment of the multi-compartment container. For example, the seal 506 may be a thin layer of plastic. In some embodiments, seal 506 may include a perforation 518 at which the seal 506 may be separated. For example, the seal 506 may be a single plastic sheet which is adhered to each of the outer walls (via lip 516) and the divider wall (via reinforcement lip 512) and which is perforated along the divider wall 508. In these embodiments, the seal 506 may be broken at the perforations such that removing the seal 506 from a first compartment will not remove the seal 506 from the second compartment.

In embodiments that include perforation 518, the perforation 518 may be added to the seal 506 before or after the seal 506 is adhered to the multi-compartment container. In some embodiments, a single reusable closure element (e.g., a plastic snap-type lid) may be fitted over the outer walls of the multi-compartment container such that air exposure to the multiple compartments is restricted by the plastic lid. In some embodiments, the seal 506 may cover a single compartment of the multi-compartment container such that a first compartment remains sealed via the seal 506 and a second compartment is sealed using a lid.

Figure 6:
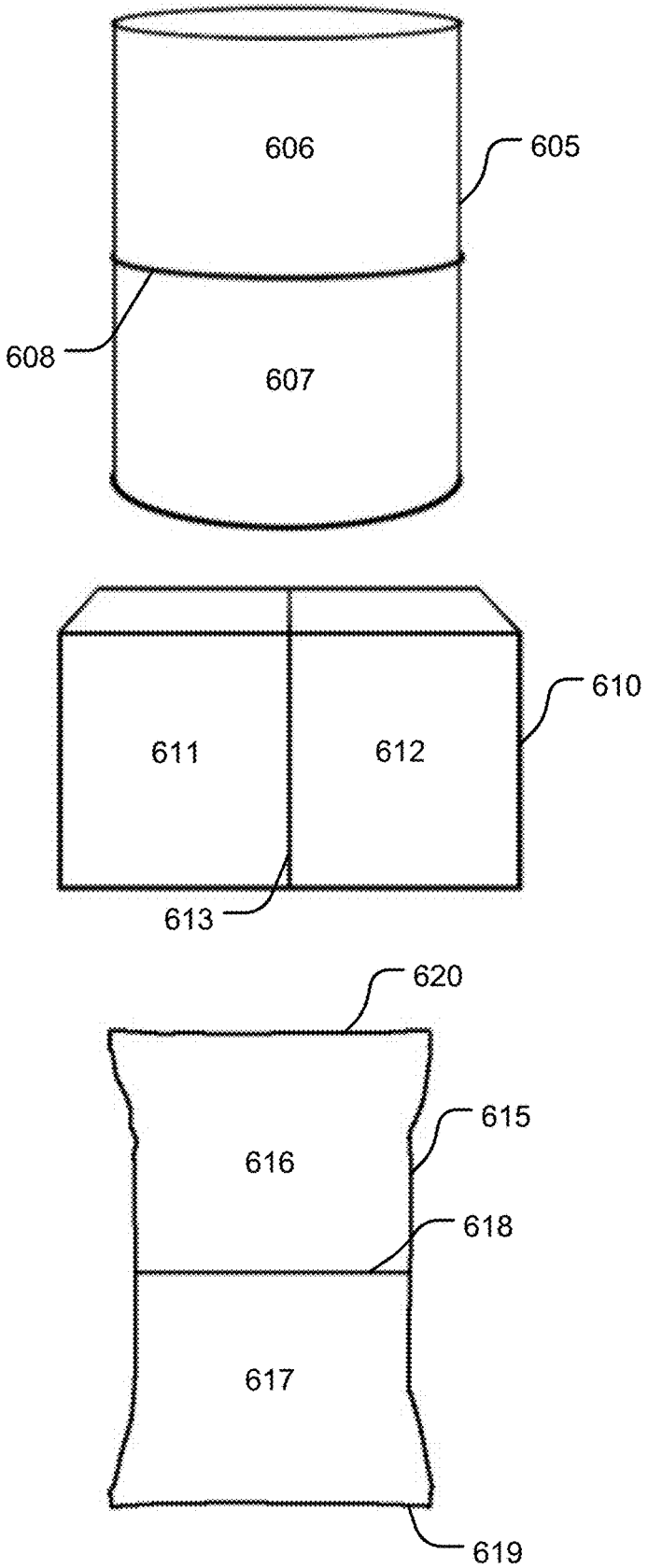
FIG. 6 shows various embodiments of a multi-compartment, including an example can or canister, box and bag or sack in accordance with at least some embodiments.

FIG. 6 shows various embodiments of a multi-compartment, including an example can or canister, box and bag or sack in accordance with at least some embodiments. The illustrations of multi-compartment canister 605, multi-compartment box 610 and multi-compartment bag 615 show the improvements according to various embodiments of the present invention. Each of the varieties of multi-compartment container, shown in FIG. 6 can be made of various materials and include various seals and lids based on the type of product that they will be used to package. Furthermore, even though the examples shown FIG. 6 each have two compartments, various embodiments of the present invention can include more than two compartments.

Canister 605 may include two compartments 606 and 607. Compartment 606 and 607, as well as other compartments in other embodiments, may be separately manufactured and then attached to one another. In such embodiments, each compartment can be a full or partial container with or without a full set of side/walls, top and bottom. Such embodiments are described in more detail in related U.S. Pat. No. 7,571,829, and U.S. patent application Ser. No. 12/622,853. Alternatively, compartments 606 and 607 of canister 605 may be made of a single cylindrical or other shape outer body with an interior divider wall 608.

The divider wall 608 may be oriented in any plane within canister 605. In yet other embodiments, canister 605 can include more than two compartments. In some embodiments, the divider wall 608 can affixed to the interior wall of a cylinder, while in other embodiments the divider wall 608 can be included in the exterior structure of the canister 605. In such embodiments, the divider wall 608 can be used to connect two cylinders of similar or dissimilar materials having either the same or different volumes.

Similarly, the divider wall 608 can have any shape to accommodate various products or the divide up the volume of the multi-compartment container into structurally or visually interesting or aesthetic volumes. For example, divider wall 608 need not be a flat disc. In fact, for the purposes of reducing the material needed to manufacture the divider wall 608, divider wall can include stamped or molded ribs to increase the structural integrity. Also, it is possible that the divider wall can be in the shape of a cone, a parabolic rotation, or bubble shape with at least one plane, edge or rim that can connect to the wall of canister 605. Such configurations can provide novel ways to divide the interior volumes of the multi-compartment container. Such embodiments can be particularly desirable for multi-compartment containers with transparent or translucent side walls, such that the divider and the separate volumes within the multi-compartment container can be seen or observed from the exterior of the multi-compartment container.

According to various embodiments of the present invention, box 610 can include at least two compartments, such as 611 and 612. Box 610 can also include more than two compartments. Box 610 can be made of various materials. For example, the walls, sides, top and bottom of box 610 can include cardboard, paperboard, metal, wood, plastic, foil, Mylar™ or some composite or combination of the foregoing materials. Any material suitable for making walls, sides, top and bottom rigid enough to contain the intended contents of box 610 can be used.

Compartment 611 and 612 can be constructed of the same or different materials. In some embodiments, box 610 having compartments 611 and 612, can be constructed of a single piece of cardboard, paper or paperboard, or plastic using known box folding pattern and construction techniques. In other embodiments, box 610 can be constructed by joining two separate boxes having compartments 611 and 612 respectively. In other embodiments, box 610 can include a divider 613 affixed to the interior of box 610. The dividing wall 613 can define compartment 611 and 612 with identical or different volumes. According to other embodiments, box 610 can have more than two compartments. The divider wall 613 can be oriented in any plane within box 610, including planes parallel or perpendicular to the long or short axes of the box 610. Divider wall 613, can also have any shape suitable for separating the volumes of compartment 611 and 612.

In various embodiments, compartments 611 and 612 can be used to package the same or different products, materials or food stuffs. Each compartment 611 and 612 can be opened, unsealed or accessed individually. In such embodiments, while the contents of one compartment are in the process of being used or consumed, the contents of the other compartment remain sealed to protect freshness or potency. Such configurations have the advantage of providing larger quantities of the product to be packaged and sold with less potential of the contents losing freshness or potency due to exposure to air. From a consumer point of view, economical quantities of products can be purchased with a lower chance that the purchased product be lost to waste. These advantages provide potential for greater profitability on the side of the manufacturer or packager by creating a more desirable packaged product and thus higher demand, at the same time as providing potential cost savings of bulk quantity purchases for the user or consumer. As used herein, the terms consumer can include any type of entity, including, but not limited to, individuals, families, restaurant, food preparation professional, chefs, workers, hospitals, hotels, etc.

Also shown in FIG. 6 is bag 615. As shown, bag 615 can have two compartments 616 and 617. In some embodiments, compartments 616 and 617 can be formed by crimping, sewing or heat welding the non-rigid or semi-rigid walls of bag 615 at seam 618. The non-rigid or semi-rigid walls of bag 615 can include paper, plastic film, foil, Mylar™, cellulose or some combination or composite thereof. Bag 615 can have its top and bottom end seams 619 and 620 sealed in the same manner. In other embodiments, seam 618 can be oriented in the longitudinal direction running from end 619 to 620. In yet other embodiments, ends 619 and 620 can include re-closable seams or seals, such as zipper-type or reusable adhesive-type closures.

Figure 7:
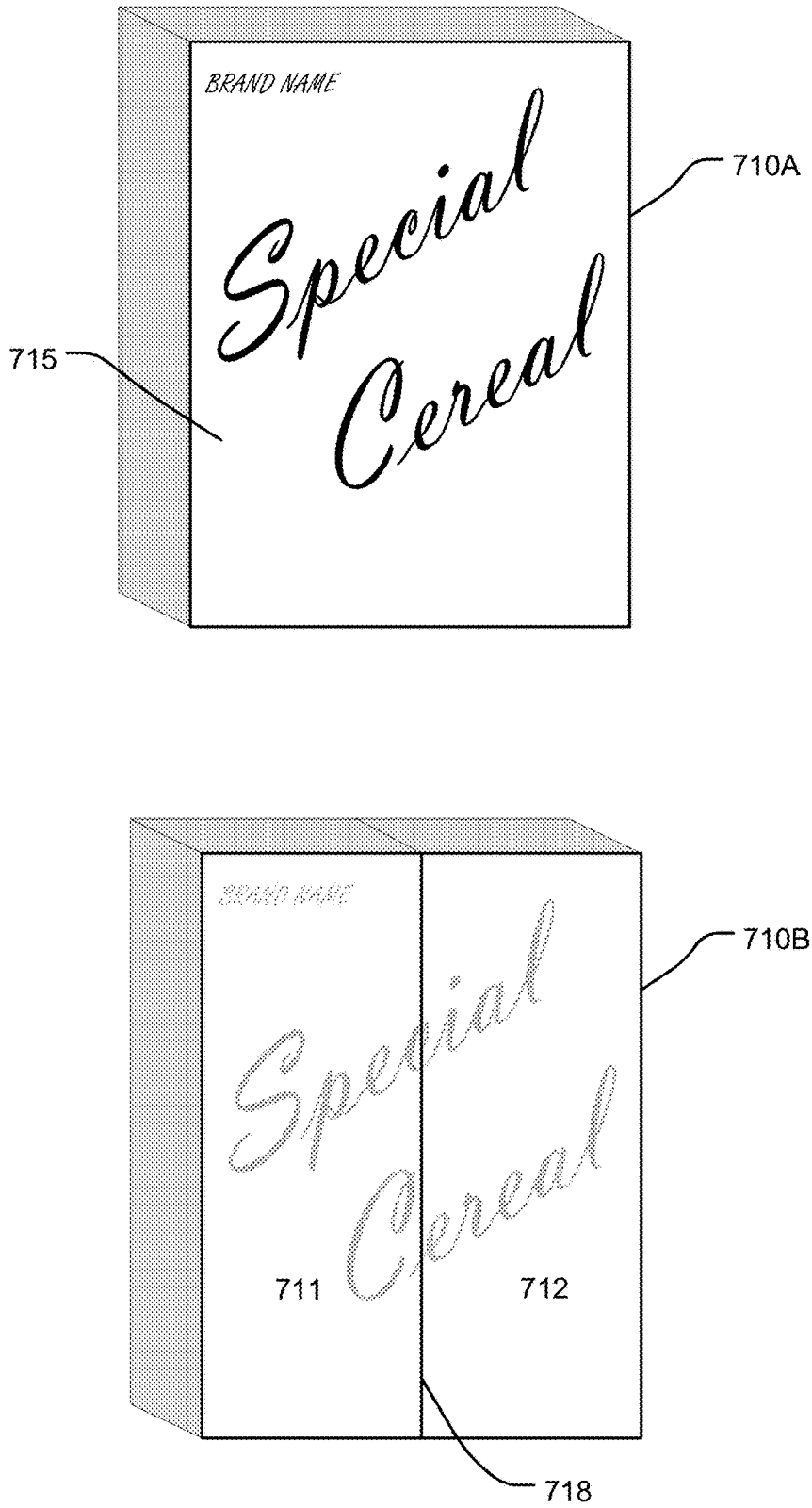
FIG. 7 shows an example of a two compartments cereal box according to one embodiment of the present invention.

FIG. 7 shows an example of a two compartments cereal box 710A according to one embodiment of the present invention. Cereal box 710A can include compartments 711 and 712. The construction of cereal box 710A can include the same materials as described above in reference to box 610. Compartments 711 and 712 can be constructed of or include the same or different materials.

In various embodiments, a consumer can access and use the contents of compartment 711 without exposing the contents of compartment 712. Once the contents of compartment 711 are depleted, a user can open or unseal compartment 712 to access the contents of that compartment. Each of compartment 711 and 712 can include desiccants. Compartments 711 and 712 can also include liners, or re-sealable or reusable lids or closures elements for creating an airtight or hermetic enclosure, separate from the airtight or hermetic enclosure of the other compartment of the multi-compartment container.

Although cereal box 710A is shown and described as a cereal box, this example is only illustrative and should not be construed as limiting a box such as 710A to being only used for packaging cereal. Cereal box 710A, as well as any other container according to other embodiments, can be used to package numerous types of dry food, commercial or industrial products that are sensitive to air, such as grains, chips, marshmallows, pretzels, nuts, dried fruit, oats, weight control supplements, protein powders, milk additives, such as chocolate milk powder, plaster of Paris, baby food, cookies, crackers, baking mixes, pancake mixes, cake mixes, brownie mixes, drink mixes, car wax, greases, sealants, epoxies, glues, cigars, cigarettes etc.

As shown, the cereal box 710A can have an exterior surface 315. Exterior surface 315 can include a material identical to that of cereal box 710A or comprise a wrapper made of a different material. For example, the body of cereal box 710A can be made of cardboard or a composite of cardboard and plastic, while the exterior surface 715 can be or wrap made of plastic film or a separate piece of paper wrapped around or otherwise affixed to cereal box 710A. In some embodiments, it is desirable for the exterior 715 to have printed information to identify the contents and the proper use of the contents of cereal box 710A and its constituent compartments 711 and 712.

Box 710B shows the interior construction of cereal box 710A. As shown, box 710B includes a divider 718 separating compartments 711 and 712. Divider 718 can be be oriented in any direction, including, but not limited to, vertical or horizontal with respect to the orientation of packaging. Divider 718 can be integral to the construction of the box 710B or can be a separate piece and even be made of a different material than the exterior 715, walls, sides, top and bottom of box 710B. In some embodiments, it is beneficial for the material of box 710B to include a composite material to further insure freshness and potency of the contents of compartments 711 and 712. To that end, it is often desirable to use a cardboard or paperboard laminated or other combined with plastic or Mylar™ type product in the construction of box 710B.

Various other boxes and containers according to various embodiments of the present invention can be made of waterproof or moisture resistant materials such as plastic. Such embodiments are particularly advantageous when the contents of multiple compartments of the containers described herein are wet or moist. For example, such multi-compartment containers are useful for dispensing one portion of pre-moistened wipes while keeping another portion fresh for future use. Such wipes can include fabric or paper based towels pre-moistened or laced with solutions, detergents, and medications for personal care and hygiene or household or industrial use. Some embodiments include wipes, moistened disinfectants, cleaners, polishes, waxes, soaps, or medications and topical solutions such as make-up removers, skin treatments, moisturizers and sanitary solutions.

Figure 8:
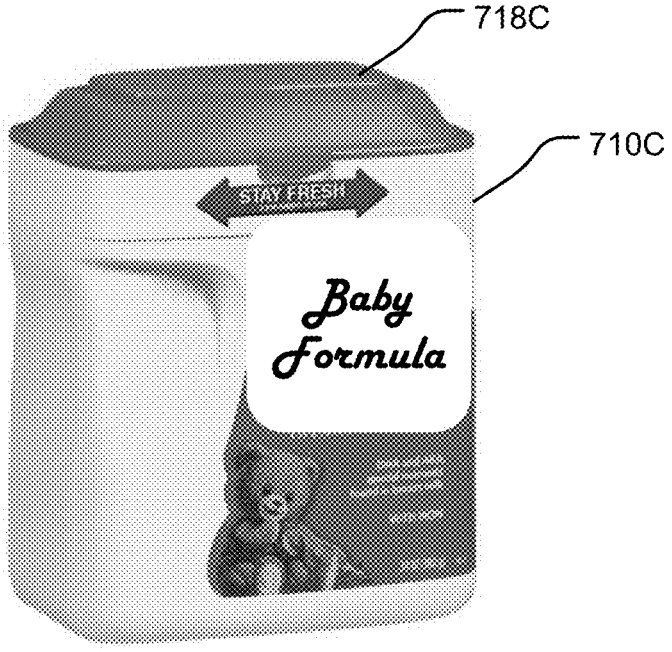
FIG. 8 shows one example of a plastic box according to one embodiment of the present invention that can be suitable for packaging dry or wet products.
Figure 8:
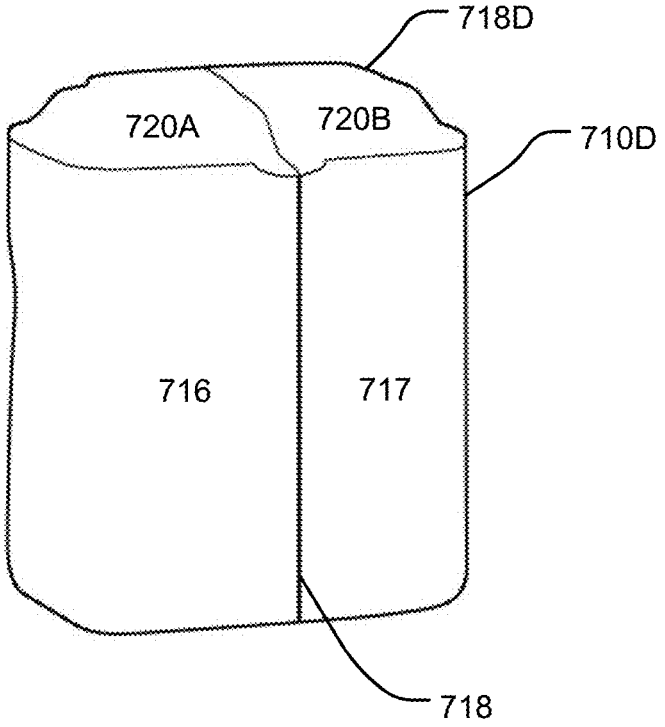

FIG. 8 shows one example of a plastic box 710C according to one embodiment of the present invention that can be suitable for packaging dry or wet products. As with the container shown in FIG. 7, the divider wall 718 in FIG. 8 can also be disposed in any orientation with respect to the other surfaces of the container.

By using an appropriate plastic or other polymer, box 710C can be used to package or contain various types of liquids and wet products that require special handling or an airtight seal to maintain usefulness. The airtight seal afforded by using a plastic material for the body and lid 718C for box 710C can be useful in other applications as well. Plastic materials are useful for making reusable and re-sealable or reusable lids or closure elements such as lid 718C. Such types of re-sealable lids or closure elements are useful for products that are used frequently or when the container is required to withstand being transported after the container is opened. For example, box 710C can be used to package products such as wet or dry baby formula that must survive being carried in a carry bag with other supplies on a regular basis while protecting the baby formula from contamination and preventing the baby formula from spilling. Such containers are also useful for frequently used and moisture sensitive products such as powdered drink, iced-tea and chocolate milk mixes.

Box 710D shows the internal construction of box 710C. As shown, box 710D can include compartments 716 and 717 that can be individually sealed with re-sealable lids 720A and 720B that make up lid 718D. In some embodiments, lids 720A and 720B can be opened and closed as a single unit or operated independently as individual lids. Embodiments in which lid 718D operates as a single piece, compartments 716 and 717 can be sealed by an additional and separately openable seals, such as one time use foil or plastic seals applied at the packaging facility. In other embodiments, lids 720A and 720B can be operated independently of one another and perform as the factory seal and the re-sealable lid for compartments 716 and 717 respectively.

In some embodiments, box 710C and 710D can be molded as a single piece or can include multiple separately molded pieces that can be adhered, welded or otherwise affixed to another to form multi-compartment boxes. In some embodiments, it may be desirable for box 710C and box 710D to include pour spouts or anti-drip spouts to prevent spills or protect the outside of the box from being contaminated or stained by the contents contained in compartments 716 and 717. Although only two compartments are described in reference to the boxes 710C and 710D are shown in FIG. 8, various other embodiments contemplate more than two compartments.

Figure 9:
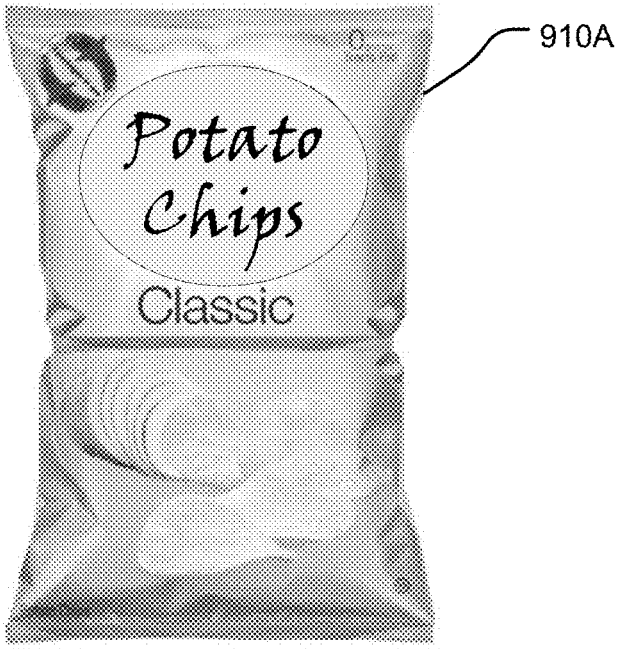
FIG. 9 shows a multi-compartment bag according to another embodiment of the present invention.
Figure 9:
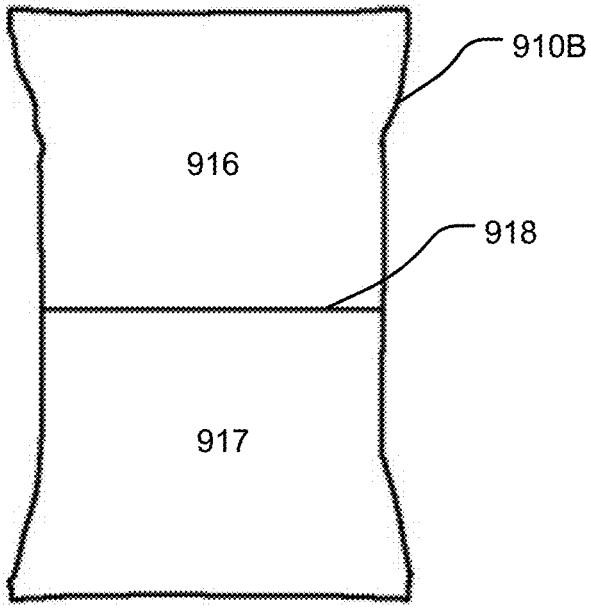

FIG. 9 shows a multi-compartment bag according to another embodiment of the present invention. Bag 910A can have sides or walls made of any suitable non-rigid or semi-rigid material for containing and maintaining freshness of the intended contents. For example, the material of the non-rigid or semi-rigid walls of bag 910A can be plastic, plastic film, Mylar, paper or biodegradable or compostable cellulose or combination thereof. The material of the walls or sides of bag 910A can include any type of flexible, non-rigid or semi-rigid material. Bag 910B shows the internal construction of bag 910A.

As shown, bag 910B can include compartments 916 and 917 divided by dividing seam 919. As in other embodiments of the present invention, compartments 916 and 917 can be used to contain or package the same or different materials from one another. Seam 918 can be formed in bag 910B to define separate compartments 916 and 917. As such, bag 910B can include compartments 916 and 917 as two separately openable pouches each having a separate portion of product therein. Seam 918 can be formed by crimping, sewing, welding or adhering the walls of bag 910B to one another to form two compartments 916 and 917. In some embodiments, seam 918 can include perforations that can be used to detach one of the compartments from the other compartments once the contents of the compartment are depleted. In such embodiments, the multi-compartment bag 910B can be reduced in size as the contents are used to save storage space and for the convenience of the user.

User or consumers can open and access the contents of each compartment or pouch individually, while maintaining the freshness of the contents of the other pouch until the contents of the first pouch are depleted.

Bags 910A and 910B can be used to package various types of materials, products and foodstuffs. For example, bag 910A can be used to package foods such as potato chips, pretzels, nuts, hot dogs, salad and other foods that are susceptible to spoilage or staleness upon exposure to oxygen and moisture. In related embodiments, each compartment of a multi-compartment bag can contain a full or partial loaf of sliced or unsliced bread. Examples of such embodiments are described in greater detail elsewhere with respect to FIG. 13.

Alternatively, bag 910A can be used to package refill portions of regularly used household goods such as dish, laundry and hand soap, as well as condiments such as ketchup mustard or mayonnaise. In such embodiments, the use of a bag 910A can help reduce the amount of packaging required for distributing regularly used household goods while also providing users and consumers with an economical quantity discount.

Figure 10:
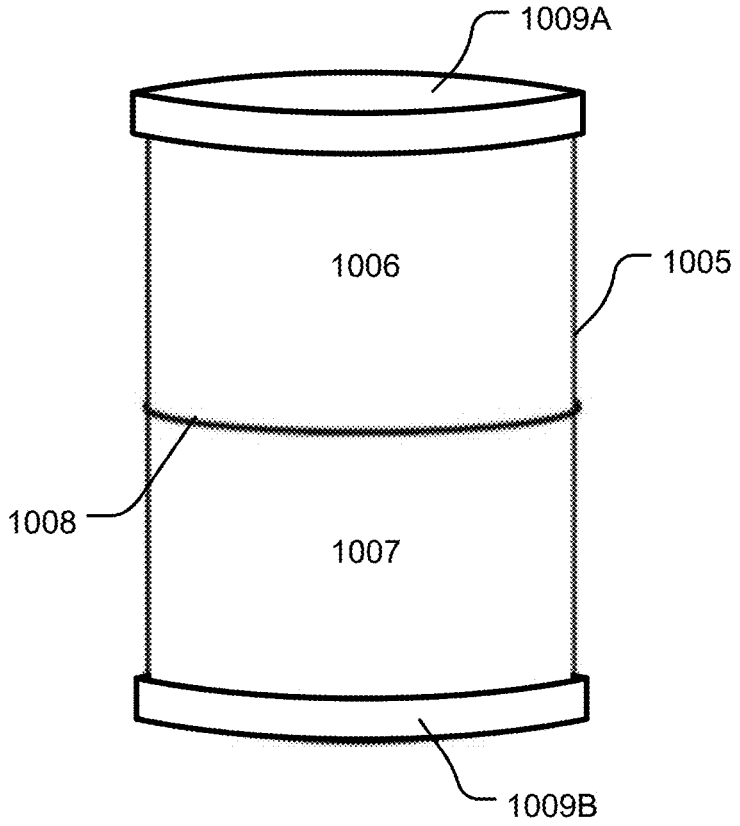
FIG. 10 shows another embodiment that can include a multi-compartment container 1005 for packaging ice cream.

FIG. 10 shows another embodiment that can include a multi-compartment container 1005 for packaging ice cream. In such embodiments, multi-compartment container 1005 can include compartments 1006 and 1007 that can contain a portion of ice cream. Each compartment 1006 and 1007 separate from one another by divider 1008, as described above in references to FIG. 6. Each compartment 1006 and 1007 can also be sealed with a plastic film, foil or Mylar™ single use cover and also include a reusable lid 1009A or 1009B respectively. The single use seals allows a consumer to open only one portion of ice cream contained in multi-compartment container 1005, thus protecting the unopened portion from freezer burn or the formation of ice crystals that can develop despite the use of the reusable lids 1009A and 1009B, and thus prevent the degradation of the flavor and texture of ice cream.

Figure 11:
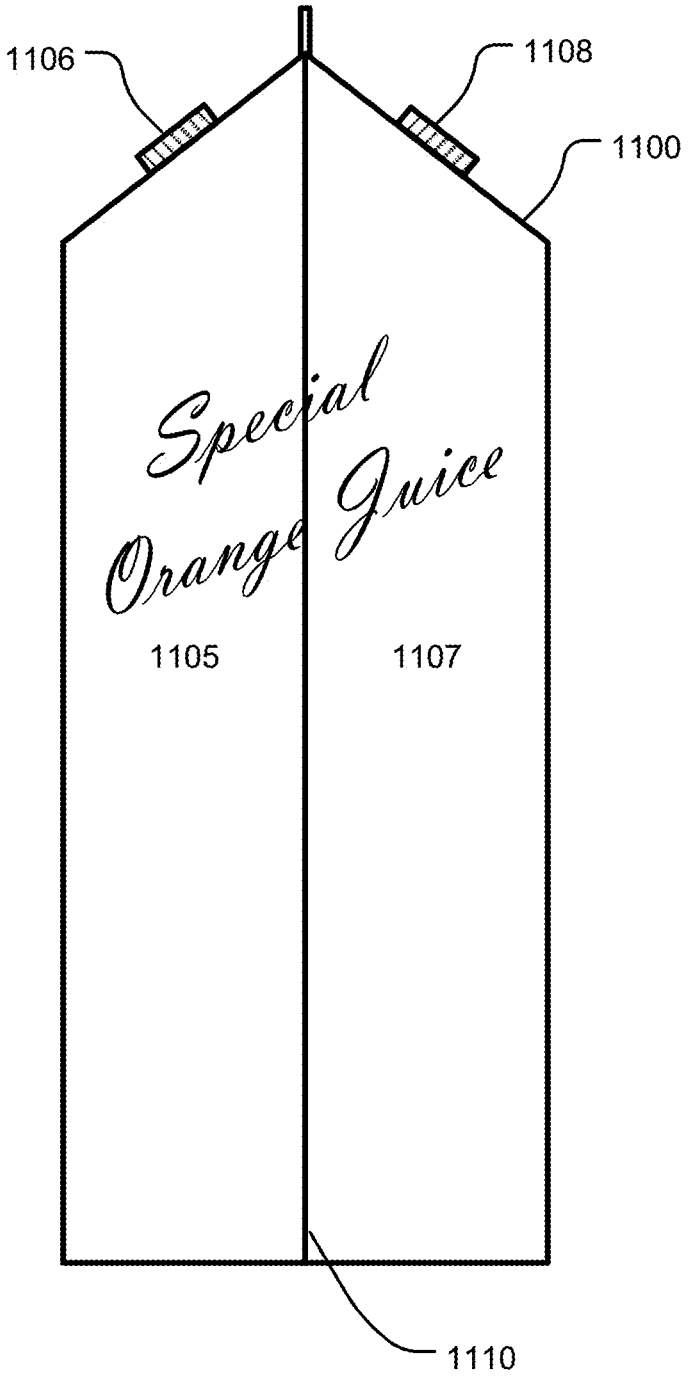
FIG. 11 show another embodiment of a multi-compartment container.

FIG. 11 show another embodiment of a multi-compartment container. In this embodiment, multi-compartment container can include a composite container for beverages or other liquids, such as dairy products like milk, cream, half and half, and buttermilk, as well as fruit and vegetable juices, soy milk, almond milks, peanut milk and other specialty beverages. Such multi-compartment containers can include at least two compartments 1105 and 1107 separated by divider 1110 that can have screw top caps like lids 1106 and 1108 respectively. Multi-compartment container 1100 can include an integrated construction, or can include two separated formed containers that are joined together along divider 1110. Multi-compartment container 1100 can include any of the aforementioned materials suitable for containing liquids.

Figure 12:
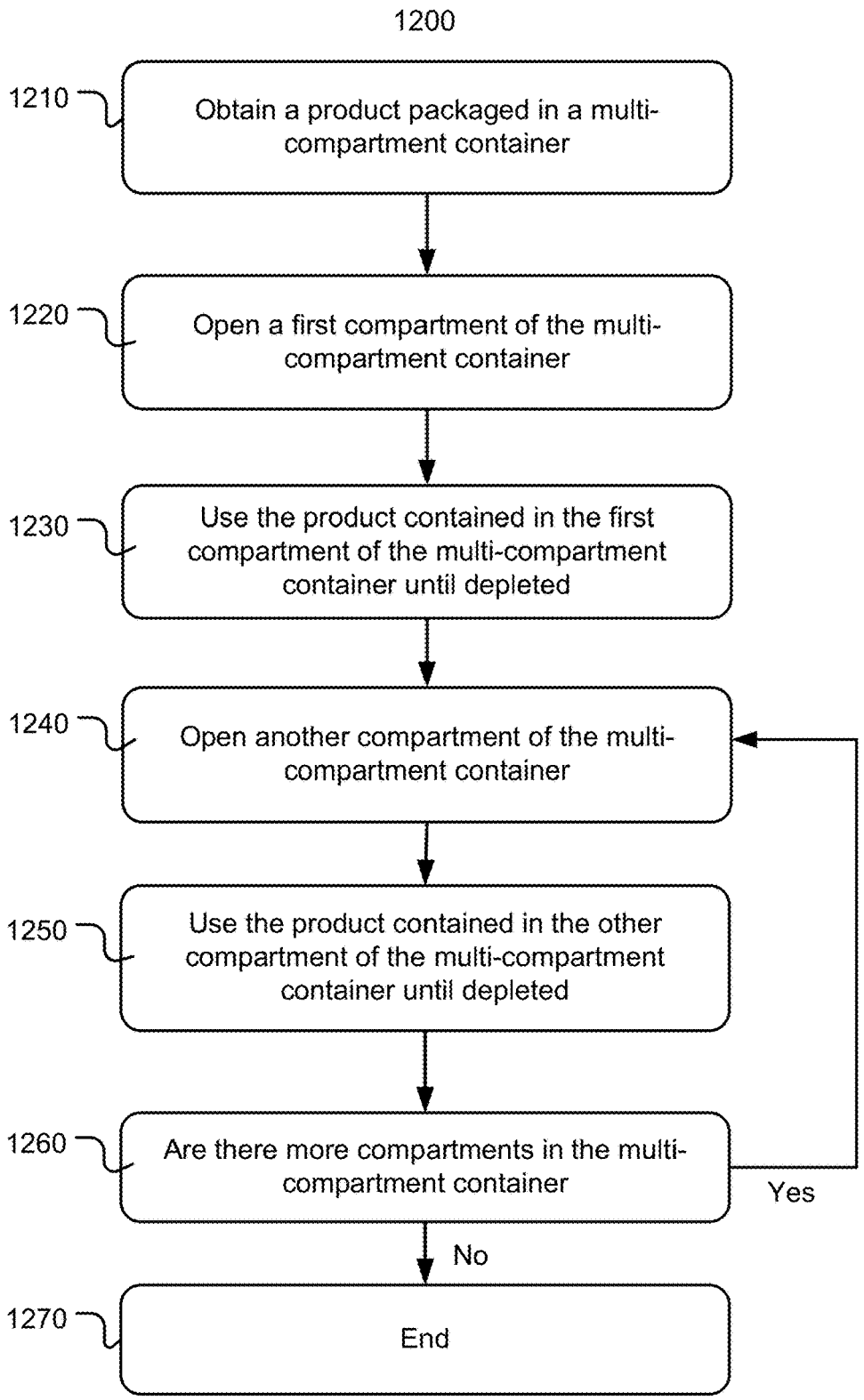
FIG. 12 is a flowchart of a method for using a multi-compartment container according to various embodiments of the present invention.

FIG. 12 is a flowchart of a method 1200 for using a multi-compartment container according to various embodiments of the present invention. At step 1210, the consumer can obtain a product packaged in a multi-compartment container. In some embodiments, obtaining a packaged product having a multi-compartment container includes buying a product at a store or ordering a product online, while in other embodiments, the user can reuse a multi-compartment container refilled with the contents of his or her choice. A multi-compartment container can be used for home canning purposes.

At step 1220, a user can open one of the compartments of the multi-compartment container as described in reference to the figures above. The contents of the first compartment of the multi-compartment container can be used either all at once or incrementally, as the contents of the multi-compartment container are needed. If the contents of the multi-compartment container are being used incrementally, the time required to complete the contents of the first compartment may be such that if the entirety of the contents of the container were exposed to air and moisture, the quality, freshness or potency of the contents might be compromised if it were not sealed in the second compartment.

In step 1230, a user can use the product contained in the first compartment of the multi-compartment container until it is depleted. At this point the user can open a second compartment of the multi-compartment container at step 1240. The contents of the second compartment of the multi-compartment container can then be used until it is depleted in step 1250. Once the product contained in the second compartment of the multi-compartment container is depleted, the user can then use any other available compartments of the multi-compartment container still containing product. This is the case if the multi-compartment container includes more than two separate compartments.

At step 1260, if there is yet another compartment of the multi-compartment container that still contains product, the user can repeat steps 1240 through 1260 until no product remains in any compartments of the multi-compartment container. Once all contents of the multi-compartment container are depleted, the user can discard, reuse or recycle the multi-compartment container in step 1270.

Figure 13A:
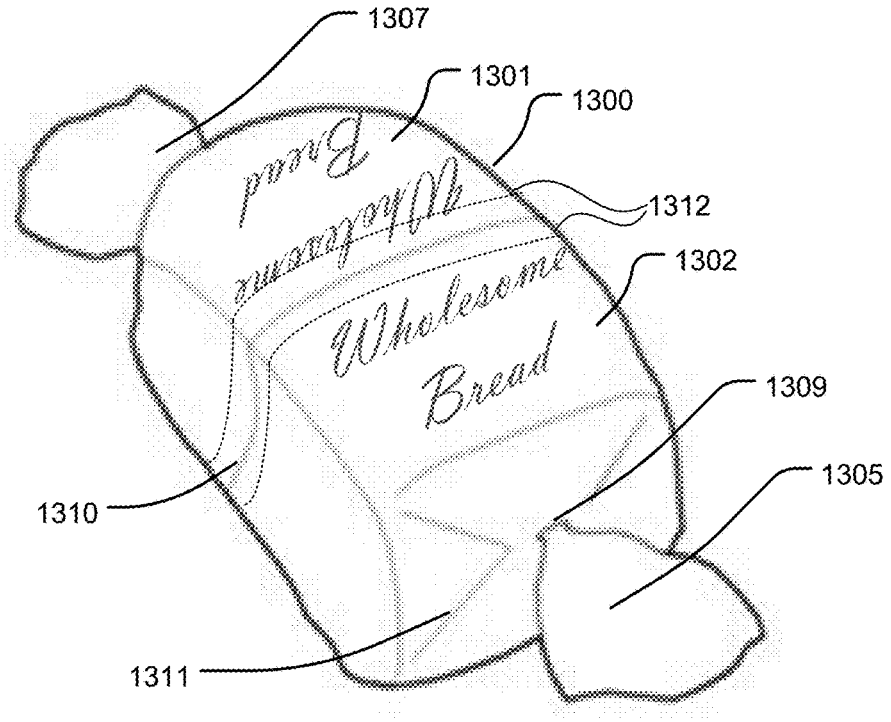
FIG. 13A and 13B depicts an illustrative example of a multi-compartment used for packaging bread in accordance with at least some embodiments.
Figure 13B:
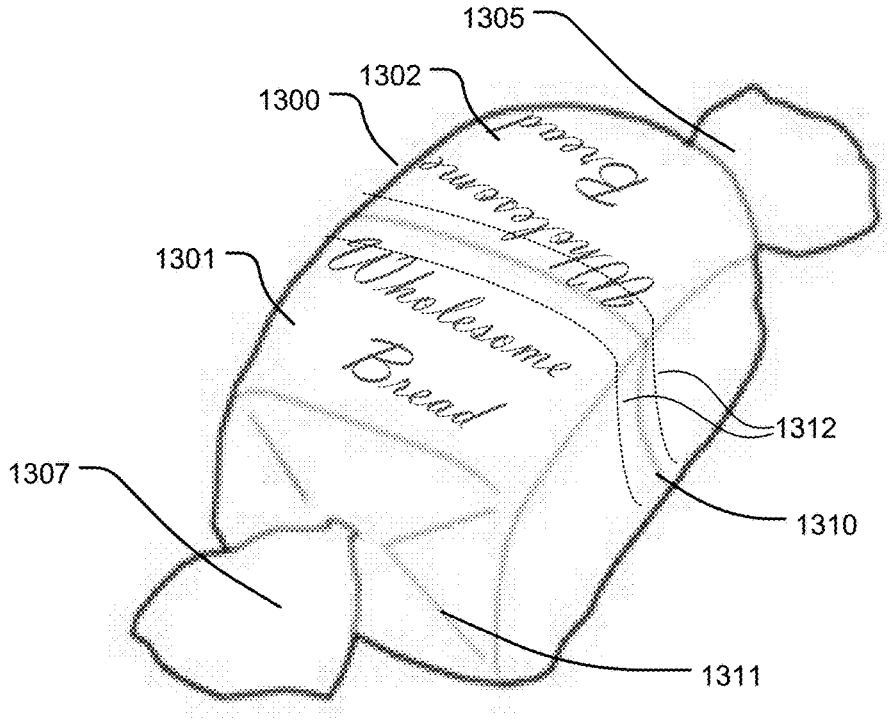

FIG. 13A and 13B depicts an illustrative example of a multi-compartment container (in this case a bag) used for packaging bread in accordance with at least some embodiments. FIG. 13A depicts the multi-compartment container 1300 from a first angle and FIG. 13B depicts the multi-compartment container from a second angle. In embodiments directed toward packaging bread shown in FIG. 13A and 13B, the divider 1310 that separates compartments 1301 and 1302 of multi-compartment container 1300 may be a sheet of similar or dissimilar material as the walls of the multi-compartment bag to provide a less constricting volume within each compartment. Such dividers may be constructed according to various methods of attaching and pleating the bag material. The pleats of divider 1310 can be similar to pleats 1311. The openable portions 1305 and 1307 of the multi-compartment container 1300 may include various closure systems to help preserve the freshness of the contents. Such closures can include twist ties 1309, clips, and zip type seals.

In some embodiments, the multi-compartment container 1300 may include a number of perforations 1312 that can be used to separate compartments 1301 and 1302. For example, the outer material of the multi-compartment container 1300 may be separated from the multi-compartment container 1300 at a first perforation 1312 upon depleting the contents of a first compartment. Alternatively, the outer material of the multi-compartment container 1300 may be separated from the multi-compartment container 1300 at a second perforation 1312 upon depleting the contents of a second compartment. It should be noted that the compartments 1301 and 1302 of the multi-compartment container 1300 may be depleted in any order. In some embodiments, the perforations 1312 may be some predetermined distance from the divider wall 1310 on the outer surface of the multi-compartment container 1300. In some embodiments, the multi-compartment container 1300 may include a single perforation 1312.

Figure 14:
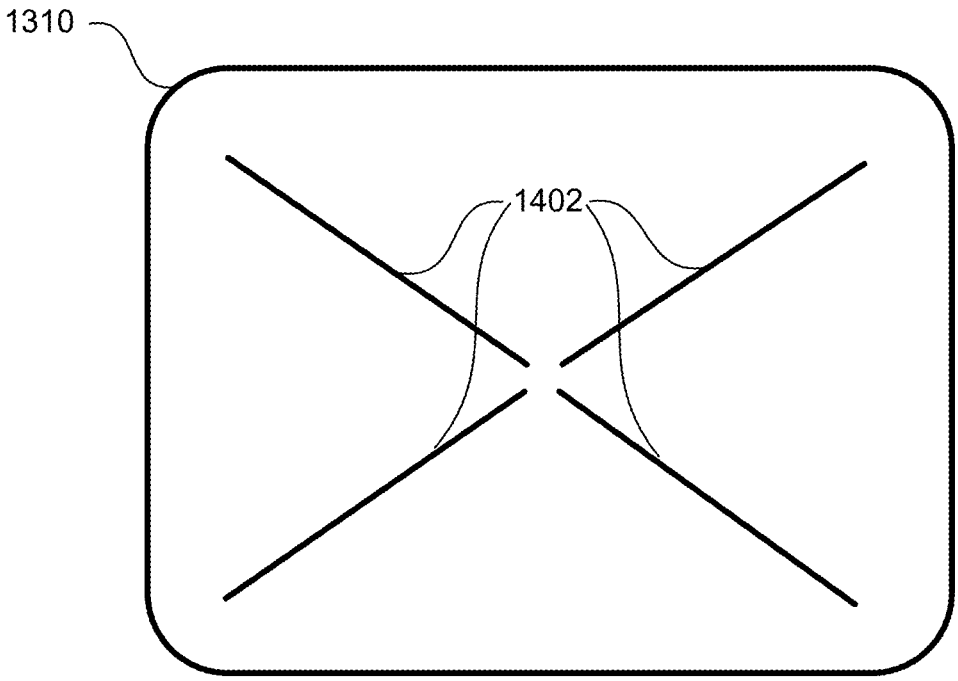
FIG. 14 depicts an illustrative example of a divider wall for a multi-compartment container.

FIG. 14 depicts an illustrative example of a divider wall for a multi-compartment container. More particularly, the divider wall 1310 may be an example of divider wall 1310 described in relation to FIG. 13 above. As discussed in FIG. 13 above, the divider wall 1310 may include a number of pleats 1402. The pleats 1402 may be similar to pleats 1311. For example, pleats 1402 may be made in the same position and style as pleats 1311.

The above description is illustrative and is not restrictive. Many variations of the invention will become apparent to those skilled in the art upon review of the disclosure.

One or more features from any embodiment may be combined with one or more features of any other embodiment without departing from the scope of the invention. For example, any of the above-described multi-compartment containers can be combined with any other suitable embodiment or type of multi-compartment container in any suitable manner in methods or systems according to embodiments of the invention. As an illustration, a multi-compartment container can have a first box type compartment and second bag type compartment. Alternatively, one compartment can have plastic or composite walls to contain wet products while the attached second compartment can have cardboard walls to contain dry products.

A recitation of "a", "an" or "the" is intended to mean "one or more" unless specifically indicated to the contrary.

What is claimed is:

1. A method of using a multi-compartment storage device comprising:

obtaining the multi-compartment storage device, wherein the multi-compartment storage device comprises:

a container comprising:

a first end;

a second end; and a container wall extending from the first end to the second end;

a divider wall defining a first compartment extending from the divider wall to the first end, and defining a second compartment extending from the divider wall to the second end;

a first perforation in the container wall, the first perforation being located between the divider wall and the first end, and the first perforation being spaced a first predetermined distance from the divider wall;

a first seal coupled to the first compartment; and a second seal coupled to the second compartment, wherein at least one of the first seal or the second seal is a reusable closure element, opening the first seal;

accessing and using first product stored in the first compartment until depleted;

separating a first portion of the container wall from the container at the first perforation, the first portion of the container wall extending from the first perforation to the first end;

opening the second seal after the first product stored in the first compartment is depleted; and accessing and using second product stored in the second compartment.

2. The method of claim 1, wherein the first compartment has a first volume and the second compartment has a second volume that is equal to the first volume.

3. The method of claim 1, wherein the first compartment has a first volume and the second compartment has a second volume that is different than the first volume.

4. The method of claim 1, wherein the divider wall is affixed to an interior surface of the container.

5. The method of claim 1, wherein the container and the divider wall are a unitary body.

6. The method of claim 5, wherein the container and the divider wall comprise a polymer.

7. The method of claim 1, wherein at least one of the first seal or the second seal is a zip type seal.

8. The method of claim 1, wherein the second end is positioned opposite the first end.

9. The method of claim 1, wherein the container wall surrounds an axis of the container and defines a container volume.

10. The method of claim 9, wherein the divider wall is positioned within the container, oriented perpendicular to the axis of the container, and intersecting the axis of the container.

11. The method of claim 9, wherein the divider wall divides the container volume, separating the first compartment from the second compartment.

12. The method of claim 9, wherein the first perforation surrounds the axis of the container.

13. The method of claim 12, wherein the first perforation lies with a first plane, and the divider wall lies with a second plane that is parallel to the first plane.

14. The method of claim 13, wherein opening the first seal creates a first opening of the first compartment, and wherein the first opening is parallel to the divider wall.

15. The method of claim 1, wherein the multi-compartment storage device further comprises:

a second perforation in the container wall, the second perforation being located between the divider wall and the second end, and the second perforation being spaced a second predetermined distance from the divider wall.

16. The method of claim 15, wherein the second perforation is located on an opposite side of the divider wall relative to the first perforation.

17. The method of claim 1, wherein the first seal is coupled to the first end, and wherein the second seal is coupled to the second end.

18. The method of claim 17, wherein the second seal is positioned opposite the first seal.

19. The method of claim 1, wherein the divider wall defines a first bottom of the first compartment and a second bottom of the second compartment.

20. The method of claim 1, wherein the container wall comprises at least one surface.

* * * * *